US008908833B2

(12) United States Patent
Nonoguchi et al.

(10) Patent No.: US 8,908,833 B2
(45) Date of Patent: Dec. 9, 2014

(54) X-RAY GENERATOR

(75) Inventors: Masahiro Nonoguchi, Tachikawa (JP); Masashi Kageyama, Ome (JP); Tomohiro Chaki, Tachikawa (JP); Masaaki Yamakata, Akishima (JP); Koichi Kato, Hamura (JP); Masaru Kuribayashi, Akishima (JP)

(73) Assignee: Rigaku Corporation, Akishima-Shi, Tokyo (JP)

( * ) Notice: Subject to any disclaimer, the term of this patent is extended or adjusted under 35 U.S.C. 154(b) by 391 days.

(21) Appl. No.: 13/337,673

(22) Filed: Dec. 27, 2011

(65) Prior Publication Data

US 2012/0163548 A1 Jun. 28, 2012

(30) Foreign Application Priority Data

Dec. 28, 2010 (JP) ..... 2010-292602
Dec. 28, 2010 (JP) ..... 2010-292603

(51) Int. Cl.

| | |
|---|---|
| ***H01J 35/10*** | (2006.01) |
| ***H01J 35/06*** | (2006.01) |
| ***H01J 35/14*** | (2006.01) |
| ***H01J 35/16*** | (2006.01) |

(52) U.S. Cl.

CPC ..... *H01J 35/10* (2013.01); *H01J 35/06* (2013.01); *H01J 35/14* (2013.01); *H01J 35/16* (2013.01); *H01J 2235/06* (2013.01); *H01J 2235/086* (2013.01); *H01J 2235/166* (2013.01); *H01J 2235/168* (2013.01)

USPC ..... 378/125; 378/136

(58) Field of Classification Search

CPC ..... H01J 35/14; H01J 2235/06; H01J 35/10

USPC ..... 378/136–138

See application file for complete search history.

(56) References Cited

U.S. PATENT DOCUMENTS

| | | | | |
|---|---|---|---|---|
| 4,352,196 | A | 9/1982 | Gabbay | |
| 5,224,142 | A | 6/1993 | Ono et al. | |
| 6,823,042 | B2 | 11/2004 | Hayashi et al. | |
| 7,352,846 | B2 | 4/2008 | Kuribayashi et al. | |
| 2006/0233308 | A1 * | 10/2006 | Nonoguchi et al. | 378/136 |
| 2007/0183576 | A1 | 8/2007 | Burke et al. | |
| 2010/0290595 | A1 * | 11/2010 | Al-Sadah et al. | 378/138 |

FOREIGN PATENT DOCUMENTS

| | | | |
|---|---|---|---|
| JP | S53-95592 | A | 8/1978 |
| JP | S55-108158 | A | 8/1980 |
| JP | H02-124652 | U | 10/1990 |
| JP | 5-13030 | A | 1/1993 |

(Continued)

*Primary Examiner* — Hoon Song
*Assistant Examiner* — Danielle Fox
(74) *Attorney, Agent, or Firm* — Buchanan Ingersoll & Rooney PC

(57) ABSTRACT

Provided is an X-ray generator comprising a cathode for generating electrons; a rotating anode having a cylindrical electron impingement surface, an X-ray focal point being formed by a region in which the electrons impinge upon the electron impingement surface; and a Wehnelt electrode for imparting an electric field to the electrons emitted from the cathode. The Wehnelt electrode has a field formation surface for forming the electric field, and an electron passage aperture formed by the field formation surface. The field formation surface of the Wehnelt electrode is inclined with respect to a plane tangent to an outer circumferential surface of the rotating anode at the center of the X-ray focal point. The center of the cathode is in a plane orthogonal to the field formation surface and aligned with the center of the electron passage aperture.

8 Claims, 11 Drawing Sheets

(56) References Cited

FOREIGN PATENT DOCUMENTS

| | | | |
|---|---|---|---|
| JP | H10-334839 | A | 12/1998 |
| JP | 2003-014895 | A | 1/2003 |
| JP | 2007-115553 | A | 5/2007 |
| JP | 2007-207757 | A | 8/2007 |

* cited by examiner

X-RAY GENERATOR

BACKGROUND OF THE INVENTION

1. Field of the Invention

The present invention relates to an X-ray generator for generating X-rays from an anticathode by causing electrons generated from a cathode to impinge upon the anticathode.

2. Description of the Related Art

The above-mentioned X-ray generator is a device for generating X-rays which are irradiated to a sample to be analyzed in an X-ray diffraction device, for example. For example, in the X-ray generator disclosed in Patent Citation 1, electrons released from a cathode body structure (corresponding to a cathode) are caused to impinge upon a tapered lateral surface of an anode target (corresponding to an anticathode) to form an X-ray focal point, and X-rays are released from the X-ray focal point. In this X-ray generator, positive ions are released from the anode target when electrons impinge upon the anode target, and there is a risk that impingement of the positive ions on the cathode may adversely affect the service life of the cathode. Impingement of positive ions on the cathode is sometimes referred to as ion bombardment.

According to Patent Citation 2, a technique is known in which a filament (corresponding to the cathode) is disposed eccentrically with respect to a Wehnelt electrode, whereby the electron irradiation region on a target (corresponding to the anticathode) is made eccentric, and positive ions released from the electron irradiation region are thereby prevented from impinging upon the filament.

PRIOR ART CITATIONS

[Patent Citation 1] Japanese Laid-open Patent Publication No. 05-013030

[Patent Citation 2] Japanese Laid-open Patent Publication No. 2007-115553

SUMMARY OF THE INVENTION

However, in the conventional device disclosed in Patent Citation 2, the installation position of the filament (cathode) with respect to the Wehnelt electrode is difficult to calculate, and adjustment for installing the Wehnelt electrode in a predetermined position with respect to a target (anticathode) is difficult to perform.

The present invention was developed in view of the problems of the prior art described above, and an object of the present invention is to provide an X-ray generator whereby positive ions released from the anticathode during generation of X-rays can be prevented from impinging upon the cathode and adversely affecting the service life of the cathode, and whereby the configuration for achieving this prevention is extremely simple.

The X-ray generator according to the present invention comprises a cathode for generating electrons; a rotating anode having a cylindrical electron impingement surface, an X-ray focal point being formed by a region in which the electrons impinge upon the electron impingement surface; and a Wehnelt electrode for imparting an electric field to the electrons emitted from the cathode; wherein the Wehnelt electrode has a field formation surface for forming the electric field, and an electron passage aperture formed by the field formation surface; and the field formation surface of the Wehnelt electrode is inclined with respect to a plane tangent to an outer circumferential surface of the rotating anode at the center of the X-ray focal point.

Through the present invention, since the field formation surface of the Wehnelt electrode is inclined with respect to the plane tangent to the outer circumferential surface of the rotating anode at the center of the X-ray focal point, the cathode can be placed in a position offset from the direction of the plane of a line normal to the outer circumferential surface of the rotating anode at the X-ray focal point. Through this configuration, positive ions that are emitted in the direction of the line normal to the outer circumferential surface of the rotating anode at the same time that X-rays are generated from the X-ray focal point can be prevented from colliding with the cathode, and as a result, it is possible to prevent a reduction in service life of the cathode.

In the X-ray generator disclosed in Patent Citation 1 (Japanese Laid-open Patent Publication No. 05-013030), FIG. 1 of this document shows a state in which a field formation surface of a cathode body structure is inclined with respect to the plane tangent to a cylindrical outer circumferential surface of an anode target (corresponding to the anticathode). However, in this document, since the X-ray focal point is formed on a tapered lateral surface of the anode target and not on the cylindrical outer circumferential surface of the anode target, this configuration is fundamentally different from the configuration of the present invention in which the X-ray focal point is formed on the cylindrical outer circumferential surface of the rotating anode.

Preferably, in the X-ray generator according to the present invention, the center of the cathode is in a plane orthogonal to the field formation surface and aligned with the center of the electron passage aperture. In other words, the Wehnelt electrode in which the aperture is formed is preferably in a positional relationship of up-down or left-right symmetry with the cathode.

In the X-ray generator disclosed in Patent Citation 2 (Japanese Laid-open Patent Publication No. 2007-115553), by offsetting the cathode an appropriate distance from the center position of the Wehnelt electrode, the progression direction of the electron beam is bent to form an X-ray focal point on the outer circumferential surface of the rotating anode, and positive ions emitted in the direction of a line normal to the rotating anode from the X-ray focal point are thereby prevented from colliding with the cathode. In this case, however, the position in which to place the cathode is extremely difficult to determine in design, and the adjustment for precisely positioning the cathode is also extremely difficult to perform. In contrast, by adopting a configuration in which the center of the cathode is in a plane orthogonal to the field formation surface and aligned with the center of the electron passage aperture, since the cathode need only be disposed in the center position of the Wehnelt electrode, design is extremely simple, and the cathode is also extremely simple to install.

Preferably, in the X-ray generator according to the present invention, the electrons emitted from the cathode progress linearly in the direction orthogonal to the field formation surface of the Wehnelt electrode. The X-ray focal point can thereby be formed in a consistent position.

In the X-ray generator according to the present invention, a configuration may be adopted in which the Wehnelt electrode has a first space provided in a position near the electron passage aperture, and a second space in a position distant from the electron passage aperture, the second space being connected to the first space and having a volume smaller than that of the first space. A portion of the cathode may be in the first space, and the remainder of the cathode may be in the second space.

In the X-ray generator according to the present invention, a configuration may be adopted in which a first X-ray blocking member is removably attached to a wall at a boundary portion between the first space and the second space; and a line normal to the outer circumferential surface of the rotating anode at the center of the X-ray focal point passes through the first space and intersects with the first X-ray blocking member. Through this configuration, positive ions generated from the X-ray focal point at the same time that X-rays are generated from the X-ray focal point can be prevented from colliding with the cathode and degrading the cathode.

In the X-ray generator, the first X-ray blocking member may be formed of a metal having molybdenum as a primary component thereof.

In the X-ray generator according to the present invention, a configuration may be adopted in which the second space is covered by a second X-ray blocking member, and a line normal to the outer circumferential surface of the rotating anode at the center of the X-ray focal point passes through the second space surrounding the cathode and intersects with the second X-ray blocking member. Through this configuration, positive ions generated from the X-ray focal point at the same time that X-rays are generated from the X-ray focal point can be prevented from colliding with the cathode and degrading the cathode.

In this configuration, the second X-ray blocking member may be formed of a metal having tungsten as a primary component thereof.

Through the present invention, since the field formation surface of the Wehnelt electrode is inclined with respect to the plane tangent to the outer circumferential surface of the rotating anode at the center of the X-ray focal point, the cathode can be placed in a position offset from the direction of the plane of a line normal to the outer circumferential surface of the rotating anode at the X-ray focal point. Through this configuration, positive ions that are emitted in the direction of the line normal to the outer circumferential surface of the rotating anode at the same time that X-rays are generated from the X-ray focal point can be prevented from colliding with the cathode, and as a result, it is possible to prevent a reduction in service life of the cathode.

DESCRIPTION OF THE PREFERRED EMBODIMENTS

First Embodiment

The X-ray generator according to the present invention will be described based on embodiments. The present invention is, of course, not limited to these embodiments. The drawings are referred to in the following description, but constituent elements are sometimes shown at a scale other than the actual scale thereof in order to facilitate understanding of characteristic portions.

Figure 1:
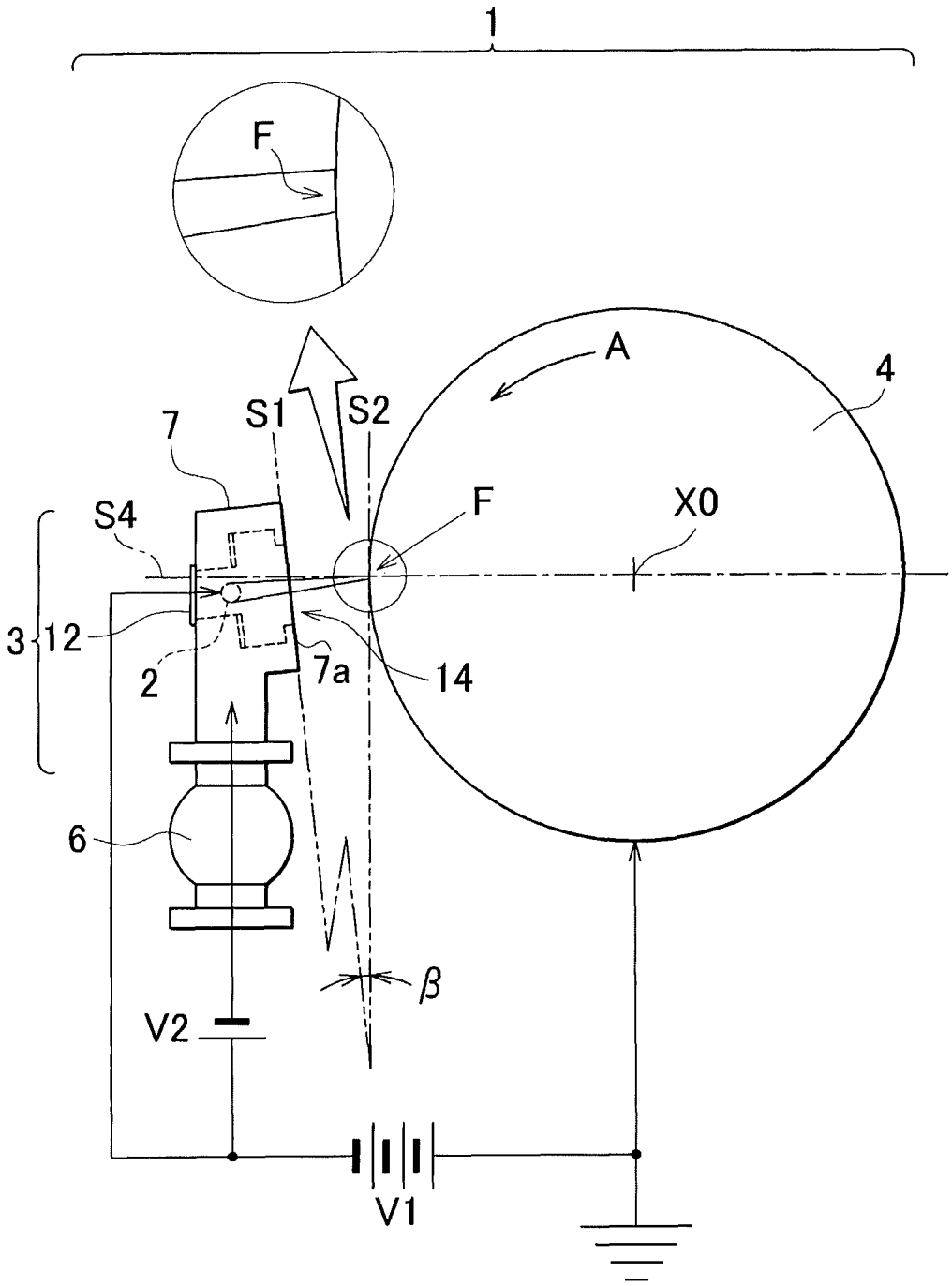
FIG. 1 is a front view showing an embodiment of the X-ray generator according to the present invention.
Figure 2:
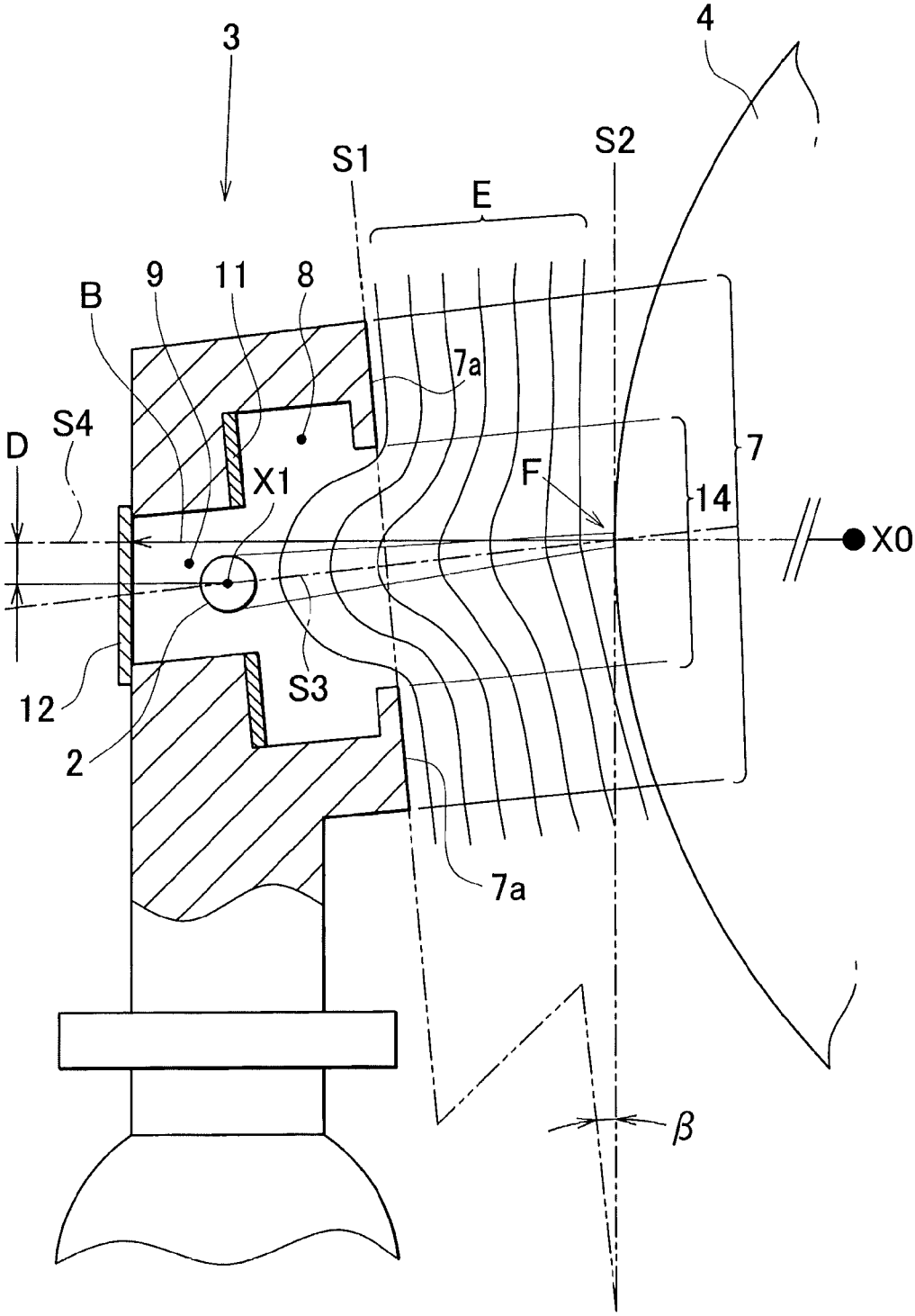
FIG. 2 is an enlarged partial cut-away view of a main part of FIG. 1 and shows the portion where the cathode and the anticathode face each other.
Figure 3:
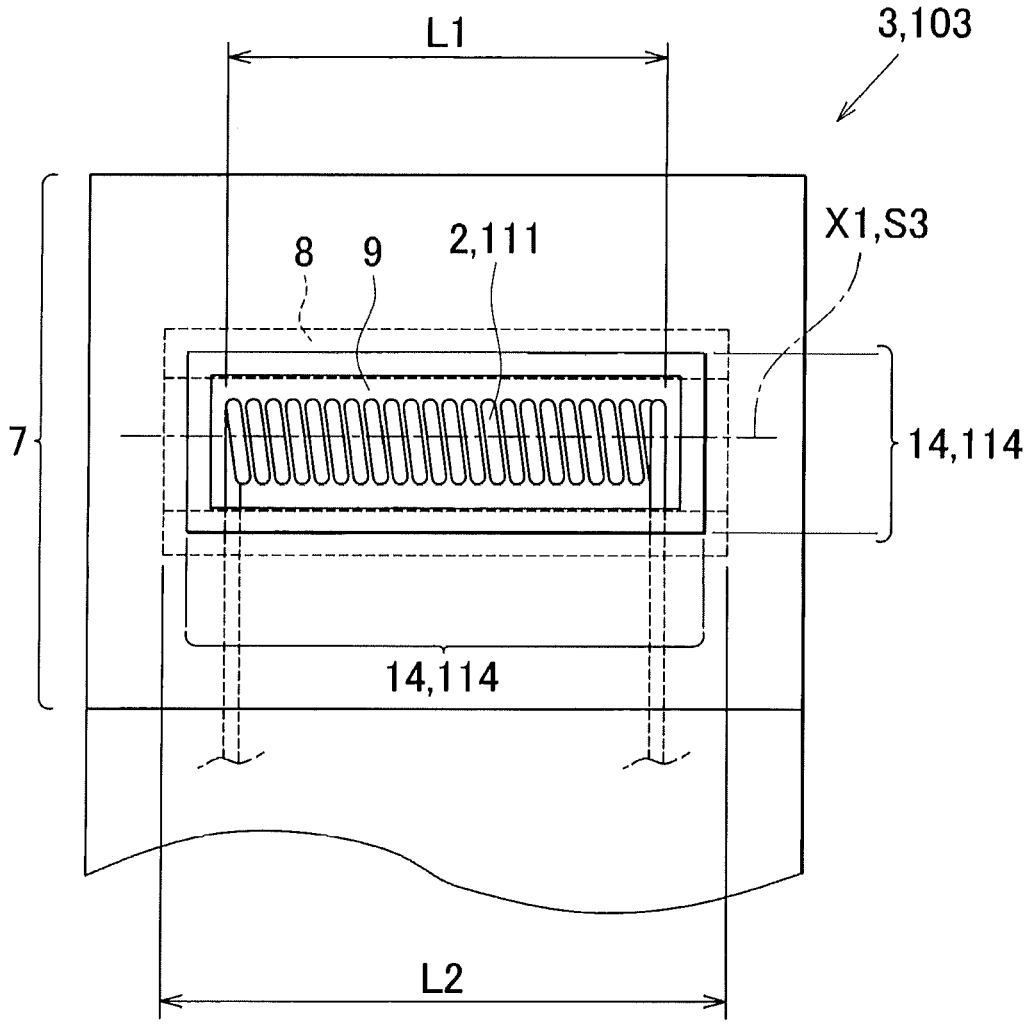
FIG. 3 is a front view showing the Wehnelt electrode as a main part of FIG. 1.

FIG. 1 is a front view showing an embodiment of the X-ray generator according to the present invention. FIG. 2 is an enlarged partial cut-away view of a main part of FIG. 1 and shows the portion where the cathode and the anticathode face each other. FIG. 3 is a front view showing the Wehnelt electrode as a main part of FIG. 1.

In FIG. 1, an X-ray generator 1 according to the present embodiment has an electron gun 3 provided with a cathode 2, and a rotating anode 4 which faces the electron gun 3. The electron gun 3 is provided on an insulator 6 which is formed of a ceramic.

The rotating anode 4 is driven by a drive device not shown in the drawings, and rotates about a central axis X0 at a predetermined speed, e.g., 9,000 to 12,000 rpm, as indicated by the arrow A. An outer circumferential surface of the rotating anode 4 is cylindrical. The cylindrical outer circumferential surface is formed of a metal, e.g., Cu (copper), Cr (chromium), or the like, which corresponds to the wavelength of the X-rays that are to be extracted.

As shown in FIG. 2, the electron gun 3 has a Wehnelt electrode 7 formed of a conductive metal, and the cathode 2 is housed in a space formed inside the Wehnelt electrode 7. The cathode 2 is formed by a coiled filament of length L1, as shown in FIG. 3. In FIG. 2, the cathode 2 extends in the direction at a right angle to the paper surface (i.e., the direction through the paper surface). The Wehnelt electrode 7 is an electrode for controlling the progression direction of electrons by applying an electric field to the electrons released from the cathode 2, according to a publicly known technique.

The internal space of the Wehnelt electrode 7 is composed of a first space 8 having a large volume and a second space 9 having a small volume. As is apparent from FIG. 3, the first space 8 and the second space 9 are cube shapes elongated in the left-right direction (horizontal direction), and the lengths L2 thereof in the left-right direction are the same. As shown in FIG. 2, the second space 9 is positioned to the rear of the first space 8 as viewed from the rotating anode 4, and is connected to the first space 8. A portion of the cathode 2 that is ring-shaped in cross-section is in the first space 8, and the remainder of the cathode 2 is in the second space 9. However, the positioning of the cathode 2 is not thus limited.

A first X-ray blocking member 11 is removably attached to a wall of the first space 8 at the boundary portion between the first space 8 and the second space 9. A second X-ray blocking member 12 is removably attached at the portion where the second space 9 opens to the outside of the Wehnelt electrode 7. The first X-ray blocking member 11 is formed of Mo (molybdenum), for example. The second X-ray blocking member 12 is formed of W (tungsten), for example.

In FIG. 1, the rotating anode 4 is electrically grounded. A negative voltage V1, e.g., V1=45 to 60 kV, is applied between the rotating anode 4 and the cathode 2. A negative voltage V2, e.g., V2=200 V, is applied between the cathode 2 and the Wehnelt electrode 7. When the voltage V2 is applied between the cathode 2 and the Wehnelt electrode 7, an electric field E shown schematically in FIG. 2 is generated between the cathode 2 and the Wehnelt electrode 7. The cathode 2 generates heat when power is applied thereto, and releases thermo electrons. The released electrons are accelerated by the voltage V1 while the progression direction thereof is controlled by the electric field E, and the electrons impinge upon the outer circumferential surface of the rotating anode 4. The region in which electrons impinge upon the outer circumferential surface of the rotating anode 4 in this manner is the X-ray focal point F, and X-rays occur in all directions in space from this X-ray focal point F.

Figure 4:
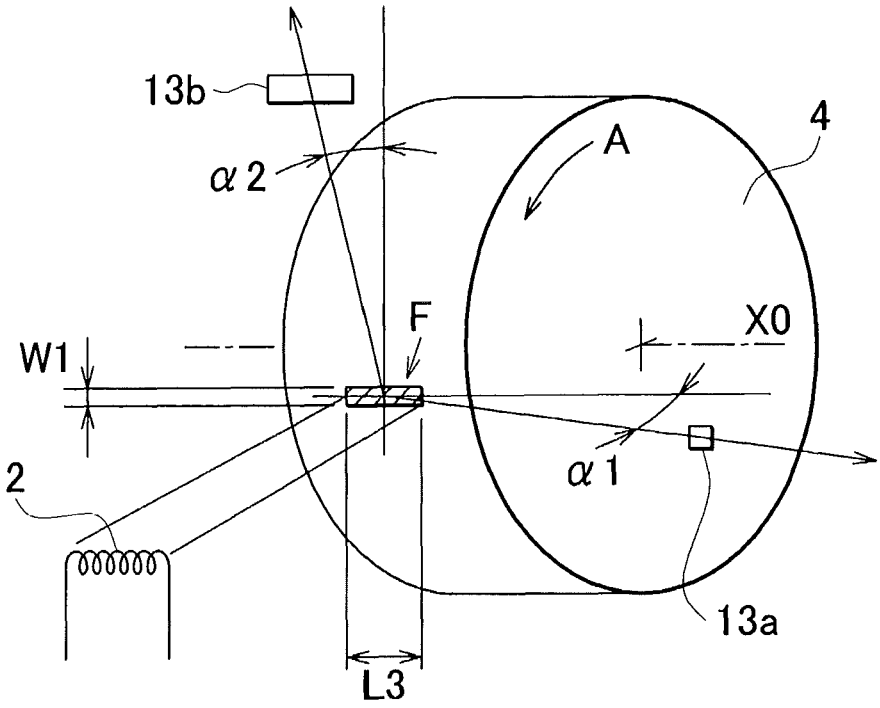
FIG. 4 is a perspective view showing the X-ray focal point formed on the outer circumferential surface of the rotating anode.

The actual X-ray focal point F formed on the outer circumferential surface of the rotating anode 4 is referred to as the real focus. The real focus F is rectangular, for example, with a width W1 and length L3 corresponding to the shape of the cathode 2, as shown schematically in FIG. 4, for example. The dimensions of the rectangle range from W1=40 μm and L3=400 μm to W1=70 μm and L3=700 μm.

The X-rays released in all directions from the X-ray focal point F are extracted to the outside from an extraction window 13*a* provided in the direction parallel to the rotational axis X0 of the rotating anode 4 (i.e., provided on a short side of the X-ray focal point F), or are extracted to the outside from an extraction window 13*b* provided in the direction at a right angle to the rotational axis X0 (i.e., provided on a long side of the X-ray focal point F). The angle α1 of the extraction window 13*a* with respect to the X-ray focal point F, and the angle α2 of the extraction window 13*b* with respect to the X-ray focal point F are referred to as X-ray extraction angles, and these angles are 5° to 6°, for example.

The X-ray focal point for the X-rays extracted from the window 13*a* on the short side of the real focus, and the X-ray focal point for the X-rays extracted from the window 13*b* on the long side of the real focus are referred to as effective foci. The effective focus of the X-rays extracted from the window 13*a* on the short side of the real focus is a 40×40 μm rectangle or a circle with a diameter ϕ of 40 μm when the real focus is 40×400 μm. On the other hand, when the real focus is 70×700 μm, the effective focus is 70 by 70 μm or a diameter ϕ of 70 μm. The X-rays thus extracted are referred to as point focus X-rays.

The effective focus of the X-rays extracted from the window 13*b* on the long side of the real focus is a 4×400 μm rectangle when the real focus is 40×400 μm. On the other hand, when the real focus is 70×700 μm, the effective focus is a 7 by 700 μm rectangle. The X-rays thus extracted are referred to as line focus X-rays. Point focus or line focus is selected for use as appropriate according to the type of measurement performed by an X-ray analysis device such as an X-ray diffractometer or an X-ray scattering apparatus.

In FIG. 2, a distal end surface 7*a* of the Wehnelt electrode 7 is significantly involved in forming an electric field E. In the present specification, the surface 7*a* is referred to as a field formation surface of the Wehnelt electrode 7. The surface 7*a* is included in a single flat plane S1. In the present specification, this plane S1 is referred to as a Wehnelt plane S1.

The field formation surface 7*a* of the Wehnelt electrode 7 forms the boundary of an aperture 14 for passing electrons that are generated from the cathode 2. Electrons pass through the aperture 14 and progress onward. In the present embodiment, the field formation surface 7*a* of the Wehnelt electrode 7, and thus the Wehnelt plane S1, is inclined at an angle β with respect to a plane (referred to hereinafter as the tangent plane) S2 that includes a line tangent to the outer circumferential surface of the rotating anode 4 at the center of the X-ray focal point F on the outer circumferential surface of the rotating anode 4. The angle β is 3°, for example. The center line X1 of the coil ring of the cathode 2 is aligned with the center of the aperture 14 for electron release and is in a plane S3 orthogonal to the field formation surface 7*a*, and thus to the Wehnelt plane S1.

Since the center line X2 of the cathode 2 is provided in the center plane S3 of the Wehnelt aperture 14, the energy received from the electric field E by the electrons emitted from the cathode 2 is always uniform, and the electrons therefore progress linearly without curving, and form the X-ray focal point F on the outer circumferential surface of the rotating anode 4.

Since the Wehnelt plane S1 that includes the aperture 14, and the tangent plane S2 through the X-ray focal point F are inclined at the angle β, the center line X1 of the cathode 2 is in a position that is offset a distance D with respect to a plane (horizontal plane in the present embodiment) S4 through the rotational center line X0 of the rotating anode 4 and the center line X0 of the X-ray focal point F. The plane S4 through the rotational center line X0 of the rotating anode 4 and the center line of the X-ray focal point F is the plane orthogonal to the tangent plane S2 of the outer circumferential surface of the rotating anode 4 at the X-ray focal point F, i.e., the normal plane.

As previously mentioned, the electrons emitted from the cathode 2 form the X-ray focal point F on the outer circumferential surface of the rotating anode 4, and X-rays radiate from the X-ray focal point F, but in this radiation of X-rays, positive ions generally are released as indicated by the arrow B along the direction normal to the outer circumferential surface of the rotating anode 4 from the X-ray focal point F. In the event that the positive ions impinge upon the cathode 2, problems arise in that degradation of the cathode 2 is accelerated and the service life of the cathode 2 is reduced.

In the present embodiment, however, since the cathode 2 is offset a distance D from the normal plane S4 of the rotating anode 4, positive ions pass through the surrounding second space 9 without colliding with the cathode 2, and collide with and are absorbed by the second X-ray blocking member 12. A reduction in service life of the cathode 2 due to impingement of positive ions can thereby be prevented, and the characteristics of the cathode 2 can be maintained for a long time. When the second X-ray blocking member 12 is degraded by prolonged impingement of positive ions, the second X-ray blocking member 12 may be replaced with another second X-ray blocking member 12.

In the X-ray generator disclosed in Patent Citation 2 (Japanese Laid-open Patent Publication No. 2007-115553), a configuration is adopted in which the cathode is offset an appropriate distance from the center position of the Wehnelt electrode, whereby the progression direction of the electron beam is bent to form an X-ray focal point on the outer circumferential surface of the rotating anode, and positive ions emitted in the direction normal to the rotating anode from the X-ray focal point thereby do not collide with the cathode. In this case, however, the position in which to place the cathode is extremely difficult to determine in design, and the adjustment for precisely positioning the cathode is also extremely difficult to perform.

In the present embodiment, however, since the cathode 2 need only be disposed in the center position of the Wehnelt electrode 7, design is extremely simple, and the cathode is also extremely simple to install.

Second Embodiment

Figure 5:
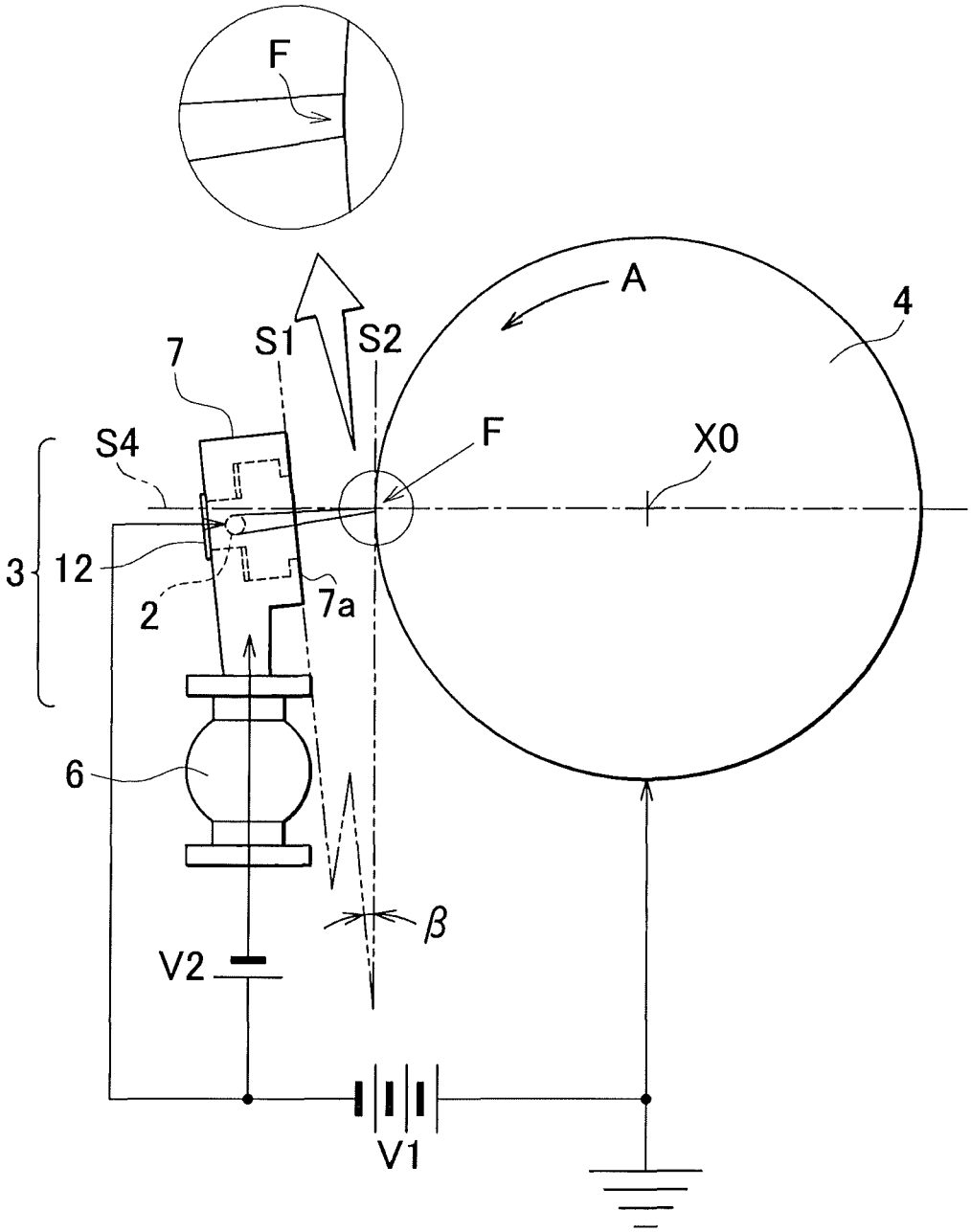
FIG. 5 is a front view showing another embodiment of the X-ray generator according to the present invention.

FIG. 5 shows another embodiment of the X-ray generator of the present invention. In the embodiment described above, a Wehnelt electrode 7 generally in the shape of a rectangular solid in which a field formation surface 7*a* at the distal end thereof is inclined is attached in an upright state (in a right-angled state) on an insulator 6, as shown in FIG. 1.

In the present embodiment, however, a Wehnelt electrode 7 generally in the shape of a rectangular solid in which a field formation surface 7*a* at the distal end thereof is not inclined (i.e., the field formation surface 7*a* is parallel to the other side surface of the Wehnelt electrode 7) is attached at an angle to the insulator 6, and an inclination angle β is thereby formed between the Wehnelt plane S1 and the tangent plane S2 of the rotating anode 4, as shown in FIG. 5.

Other members for which the same reference symbols are used as in FIG. 1 are the same as in FIG. 1, and will not be described. In the present embodiment as well, by providing an inclination angle β between the Wehnelt plane S1 and the tangent plane S2 of the rotating anode 4, positive ions can be prevented from impinging upon the cathode 2, and as a result, a long service life for the cathode 2 can be maintained. Since the cathode 2 need only be disposed in the center position of the Wehnelt electrode 7, design is extremely simple, and the cathode is also extremely simple to install.

Third Embodiment

Figure 6:
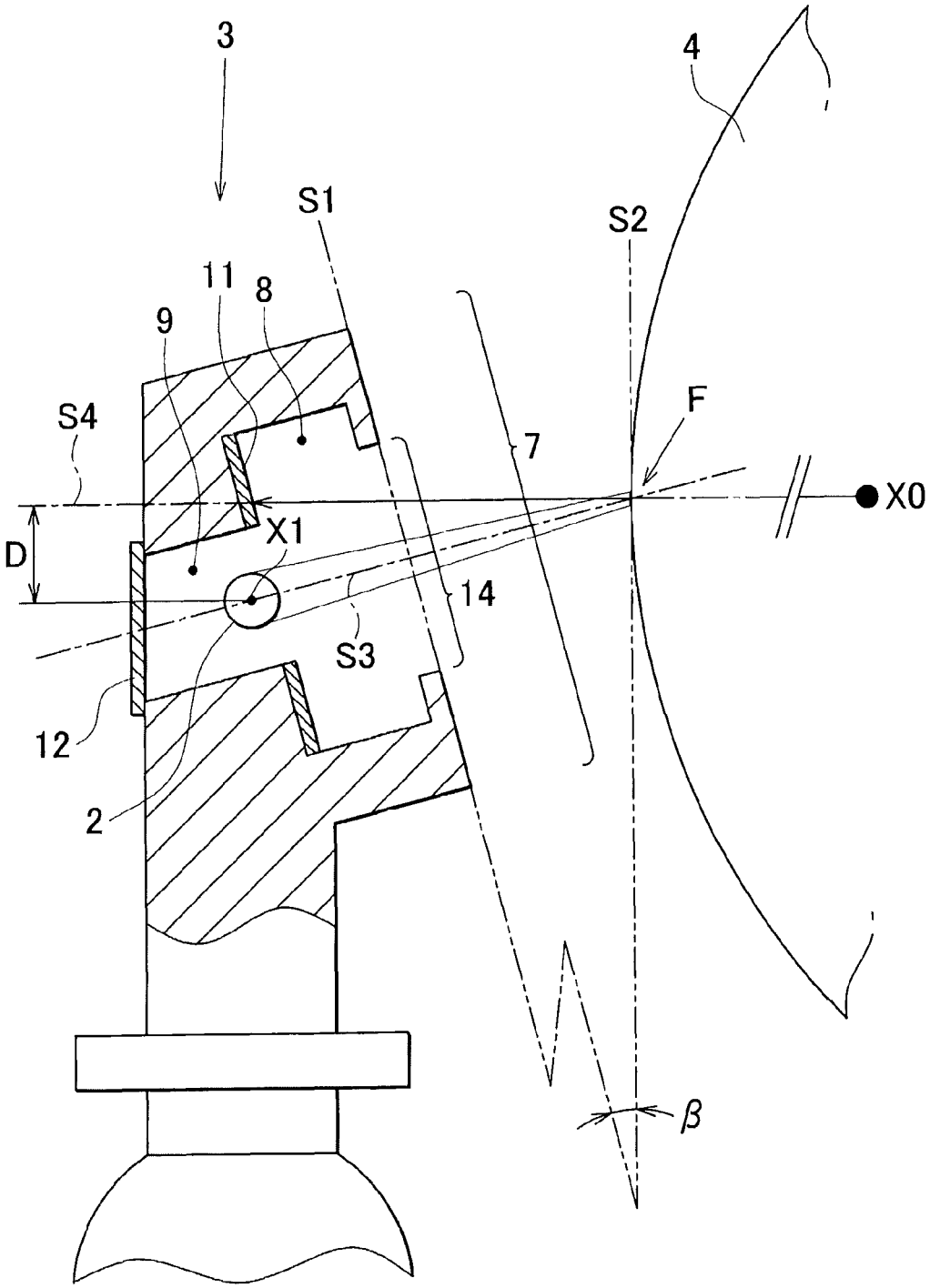
FIG. 6 is a partial cut-away front view showing the main part of a still another embodiment according to the X-ray generator of the present invention.

FIG. 6 shows a still another embodiment of the X-ray generator of the present invention. In the embodiments described above, a configuration is adopted whereby positive ions generated in the direction S4 of the plane normal to the outer circumferential surface of the rotating anode 4 at the same time that X-rays are generated from the X-ray focal point F of the rotating anode 4 are caused to collide with and be absorbed by the second X-ray blocking member 12 covering the second space 9 in the Wehnelt electrode 7, as shown in FIG. 2.

In the present embodiment, however, positive ions progressing in the direction S4 of the plane normal to the X-ray focal point F of the rotating anode 4 are caused to collide with and be absorbed by the first X-ray blocking member 11 in the first space 8 within the Wehnelt electrode 7, as shown in FIG. 6. When the first X-ray blocking member 11 is degraded by prolonged impingement of positive ions, the first X-ray blocking member 11 may be replaced with another first X-ray blocking member 11.

Fourth Embodiment

Figure 7:
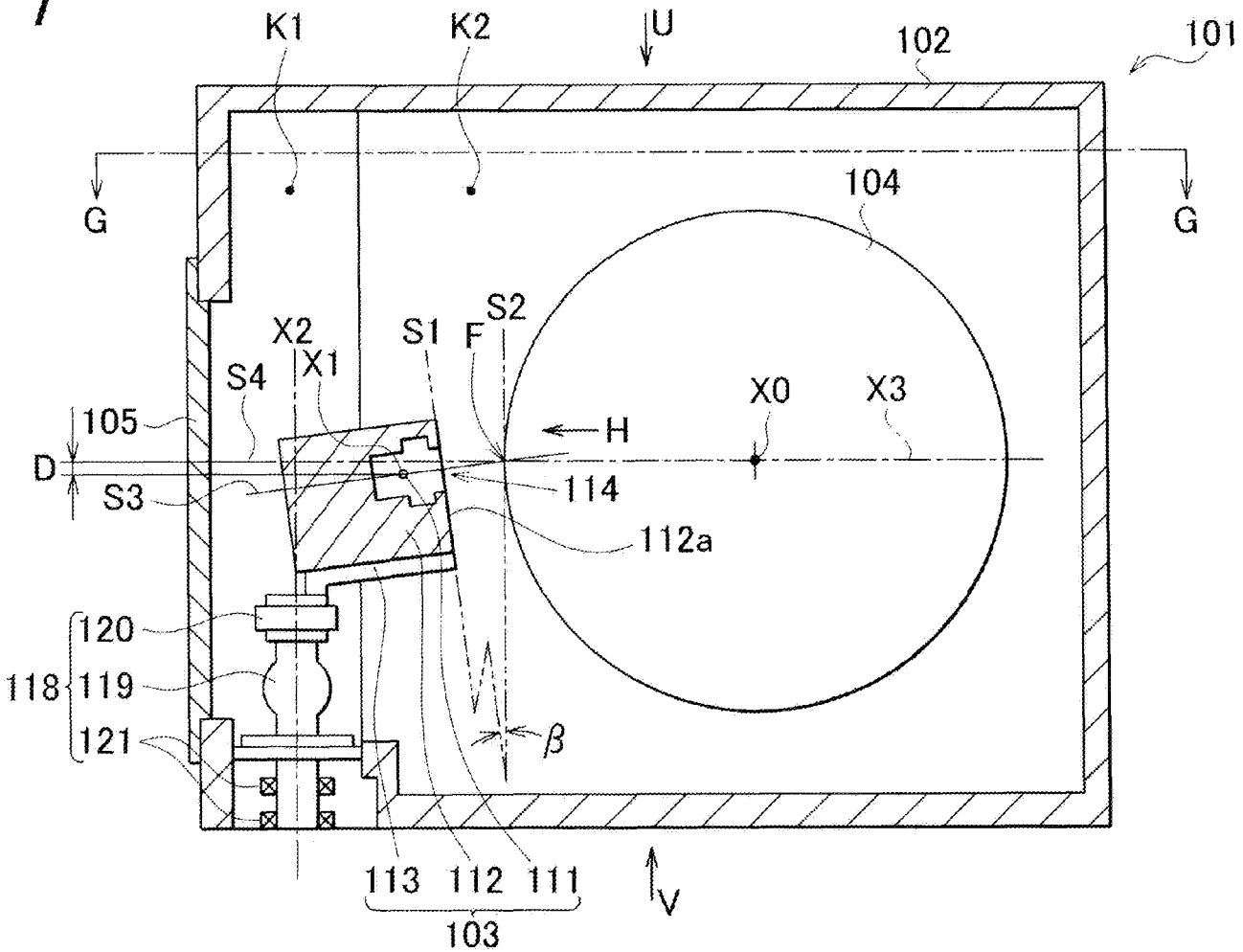
FIG. 7 is a front view showing a still another embodiment of the X-ray generator of the present invention.
Figure 8:
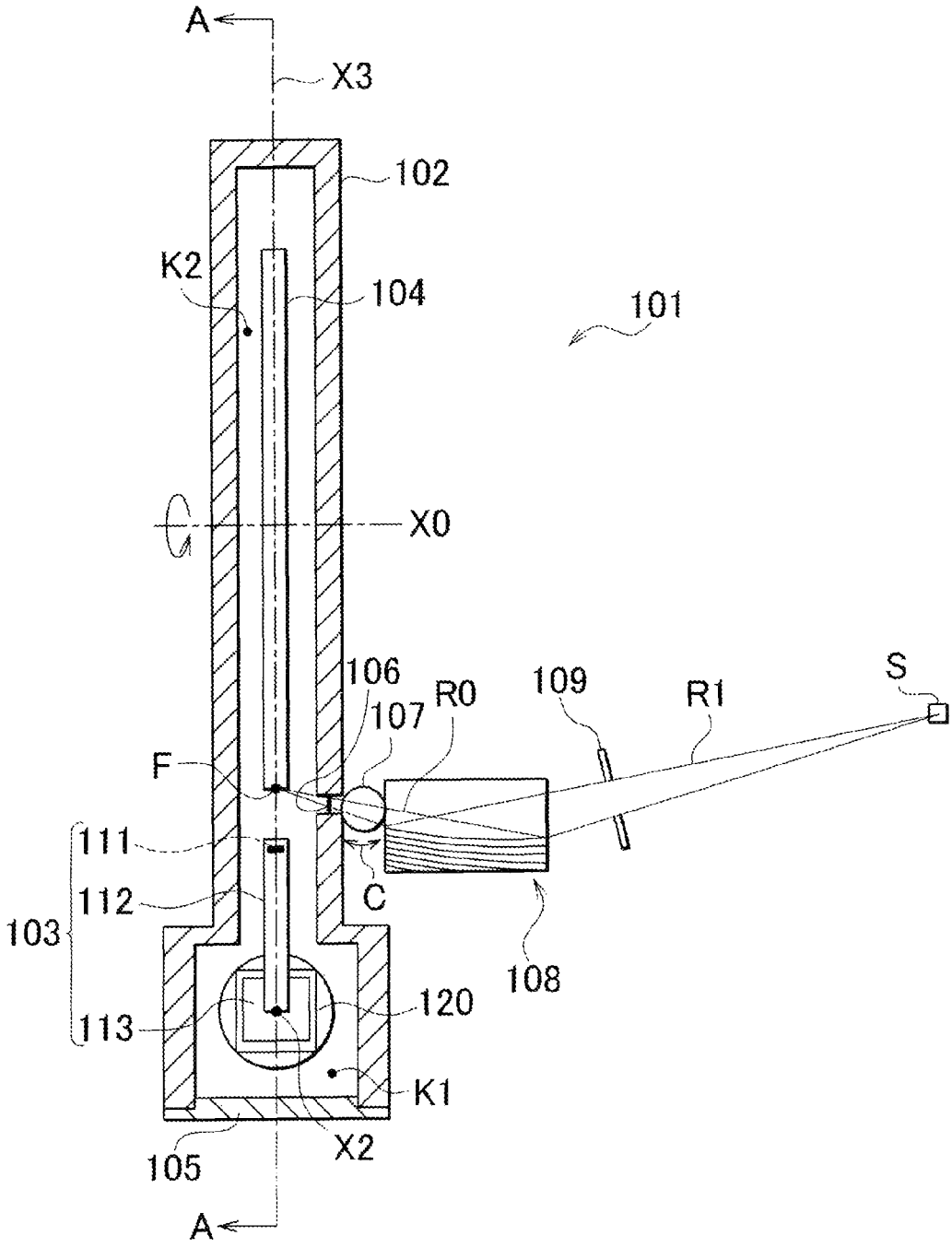
FIG. 8 is a sectional plan view taken along the line G-G in FIG. 7.
Figure 9:
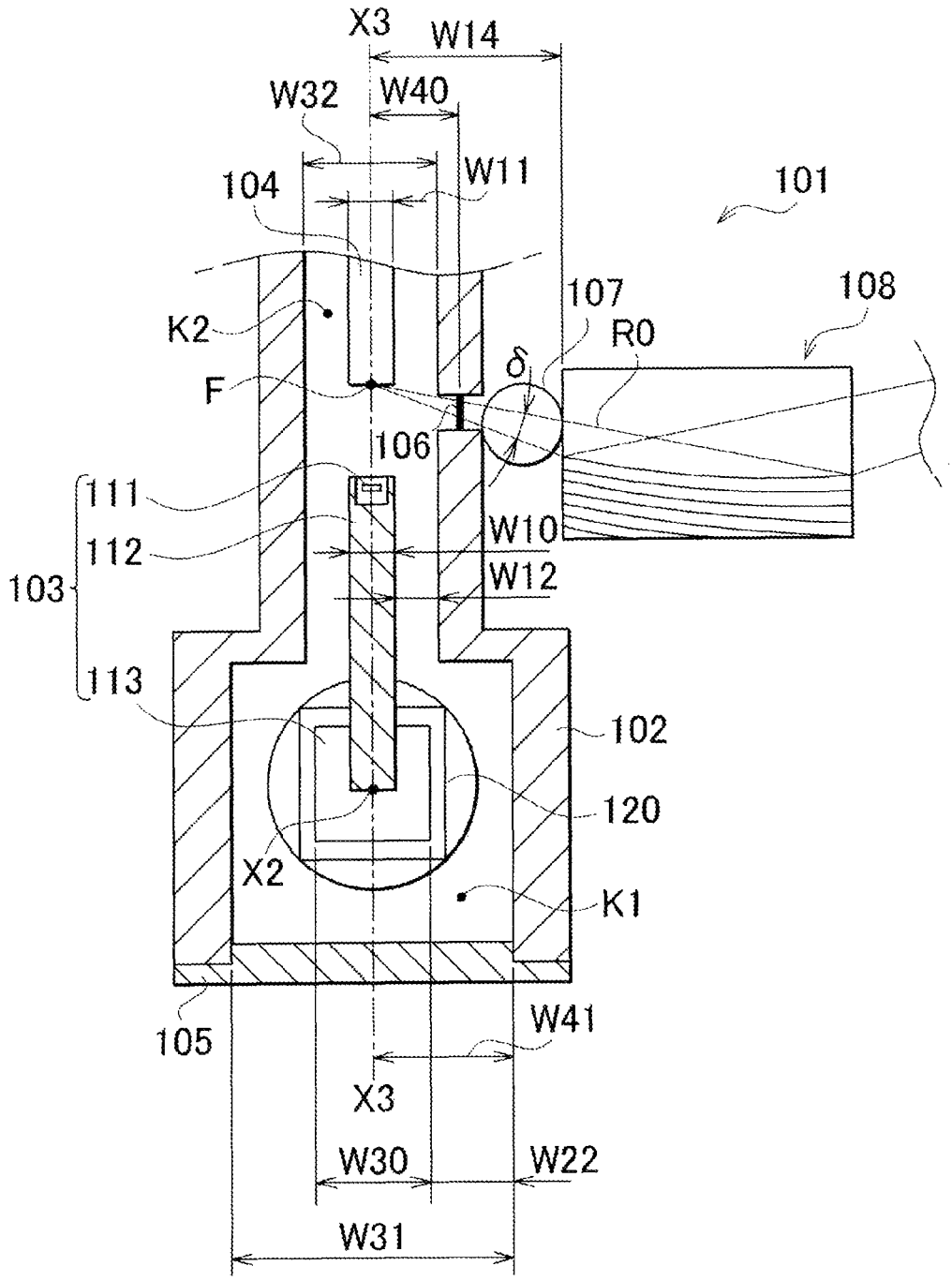
FIG. 9 is an enlarged view showing the electron gun and surrounding area thereof, the electron gun being a main part of FIG. 8.

FIGS. 7, 8, and 9 show a still another embodiment of the X-ray generator of the present invention. FIG. 7 is a sectional side view showing the X-ray generator. FIG. 8 is a sectional plan view along line G-G of FIG. 7, and shows the X-ray generator. FIG. 9 is an enlarged view showing the electron gun and surrounding area thereof, the electron gun being a main part of FIG. 8.

In these drawings, an X-ray generator 101 has a metal casing 102, an electron gun 103 provided inside the casing 102, and a rotating anode 104 provided opposite the electron gun 103. An X-ray extraction window 106 is provided in a portion of a wall of the casing 102 at a portion thereof where the electron gun 103 and the rotating anode 104 face each other. The X-ray extraction window 106 is formed of a material, e.g., Be (beryllium), that is capable of passing X-rays. An end part of the casing 102 on the side thereof on which the electron gun 103 is provided forms an aperture of sufficient size to allow the electron gun 103 (i.e., a Wehnelt electrode 112 and an attachment part 113 integrated therewith, described hereinafter) to be taken in and out. The aperture is closed by a cover 105. The cover 105 can be attached to and detached from the casing 102 by a screw or other fastening means.

FIG. 8 shows an example in which an X-ray extraction window 106 is provided in the right-side wall (wall on the near side not shown in FIG. 7) of the casing 102, but the X-ray extraction window 106 may also be provided in the left-side wall (wall on the far side in FIG. 7) of the casing 102. The X-ray extraction window 106 may also be provided in the near side and/or the far side (i.e., the upper side U and/or the lower side V of the X-ray generator 101 shown in FIG. 7).

The X-ray generator 101 also has an X-ray shutter 107 provided near the outer part of the X-ray extraction window 106, a monochromator 108 provided with light-focusing capability as an X-ray conditioning element provided at the rear (right-side part in FIG. 8) of the X-ray shutter 107, and a slit 109 for blocking the progress of unnecessary X-rays. The X-ray extraction window 106 has an irradiation angle wider than the range angles δ (refer to FIG. 9) at which the monochromator 108 captures the X-rays generated from the X-ray focal point F. An X-ray conditioning structure other than a monochromator may also be used as the X-ray conditioning element.

In a case in which the X-ray generator 101 is applied in an X-ray measurement device, i.e., an X-ray analyzer, the X-rays that pass through the slit 109 irradiate an extremely small region of a sample S, e.g., a protein. For example, the irradiated region is within the range of 50×50 μm to 150×150 μm. In the case that diffraction occurs in the sample S, the diffracted rays are detected by an X-ray detector not shown in the drawings. The X-ray measurement device is not limited to a specific configuration, and the present invention may be applied in a device for measuring diffraction by a focusing method, a device for measurement diffraction by a parallel beam method, and various other types of X-ray measurement devices.

The electron gun 103 has a filament 111 as a cathode, a Wehnelt electrode 112 for surrounding the filament 111, and an attachment part 113 which is formed integrally with the Wehnelt electrode. In the present embodiment, the entire Wehnelt electrode 112 is formed of a single metal material. However, the Wehnelt electrode 112 may also be formed by a plurality of parts as needed.

The filament 111 is formed of W (tungsten), for example. As shown in FIG. 3, the cathode filament 111 is formed by a coil, i.e., a helical filament, of length L1. An aperture 114 for passing electrons is provided in front of the filament 111.

As is apparent from FIGS. 7 and 8, the rotating anode 104 is formed in a disc shape. The outer circumferential surface of the rotating anode 104 is formed of a material capable of generating X-rays of the desired wavelength. In the case that CuKα rays are desired, for example, the rotating anode 104 is formed of Cu (copper).

The combination of the filament and the target is not limited to a combination of tungsten and copper. For example, the filament may be obtained by forming rod-shaped or plate-shaped $LaB_6$ (lanthanum hexaboride) having a rectangular cross-sectional shape into an appropriate apparent shape, rather than being composed of coiled tungsten. The target may also be Cr (Chromium) or W (tungsten).

The rotating anode 104 is driven by a drive device not shown in the drawings, and rotates about a center line X0 that extends in the width direction (i.e., the direction orthogonal to the circular plane) of the anticathode 104. The rotating anode 104 rotates at a rotation speed of 9,000 to 12,000 rpm, for example. Although not shown in the drawings, the drive device may be of any configuration, such as a belt-drive scheme in which a drive source and a center shaft of the rotating anode 104 are linked by a belt, or a direct-drive scheme in which a center shaft of the rotating anode 104 is directly driven in rotation by electromagnetic force, for example. The shape of the casing 102 may change in the case that a different drive method is employed, but in any case, a hermetic seal is maintained inside the casing 102.

Figure 11:
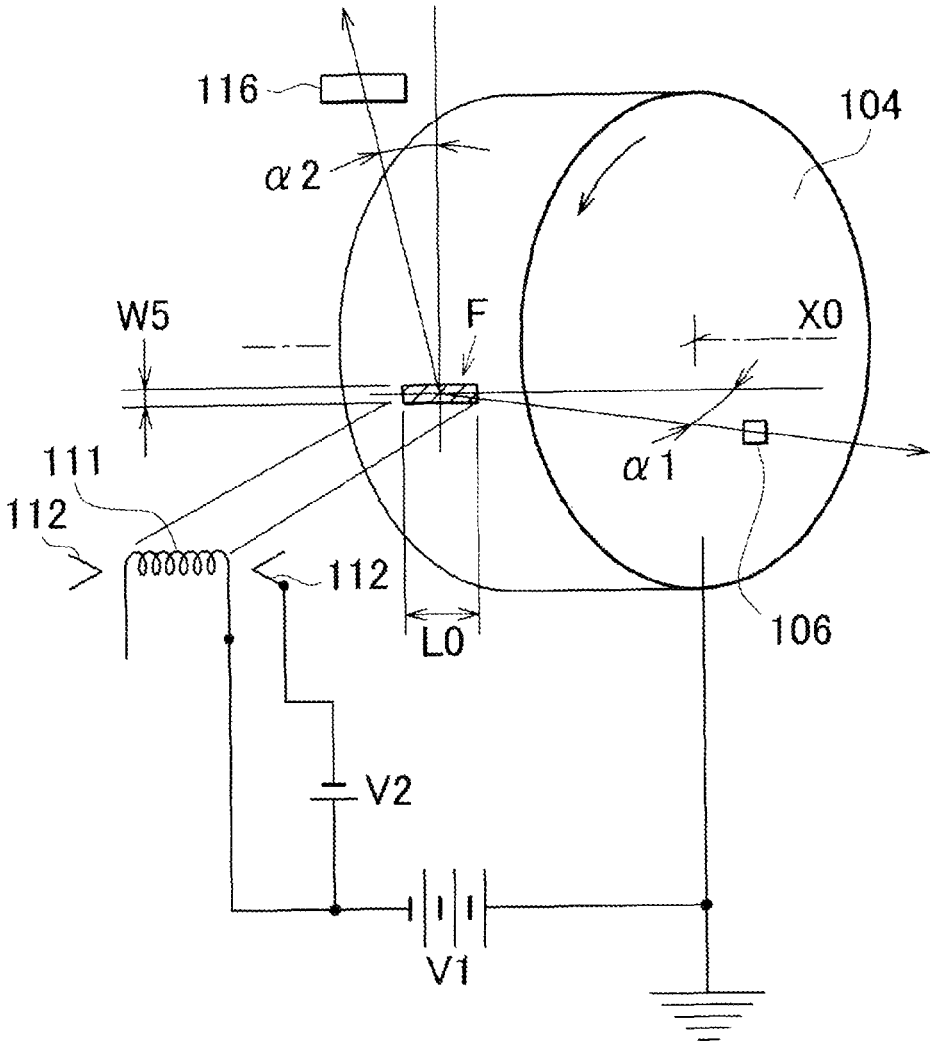
FIG. 11 is a perspective view showing the X-ray focal point formed on the outer circumferential surface of the rotating anode.

FIG. 11 is a schematic view showing the cathode filament 111 and the rotating anode 104. In FIG. 11, the rotating anode 104 is electrically grounded. A negative voltage V1, e.g., V1=45 to 60 kV, is applied between the rotating anode 104 and the filament 111. A negative voltage V2, e.g., V2=200 V, is applied between the filament 111 and the Wehnelt electrode 112. The filament 111 generates heat when power is applied thereto, and releases thermo electrons. The released electrons are accelerated by the voltage V1 while the progression direction thereof is controlled by the Wehnelt electrode 112, and the electrons impinge upon the outer circumferential surface of the rotating anode 104. The region in which electrons impinge upon the outer circumferential surface of the rotating anode 104 in this manner is the X-ray focal point F, and X-rays occur in all directions in space from this X-ray focal point F.

The actual X-ray focal point F formed on the outer circumferential surface of the rotating anode 104 is referred to as the real focus. The real focus F is rectangular, for example, with a width W5 and length L0 corresponding to the shape of the filament 111, for example. The dimensions of the rectangle range from W5=40 μm and L0=400 μm to W5=70 μm and L0=700 μm.

The X-rays released in all directions from the X-ray focal point F are extracted to the outside from an extraction window 106 provided in the direction parallel to the rotational center line X0 of the rotating anode 104 (i.e., provided on a short side of the real focus F), or are extracted to the outside from an extraction window 116 provided in the direction at a right angle to the rotational center line X0 (i.e., provided on a long side of the real focus F). The angle $\alpha$1 of the extraction window 106 with respect to the X-ray focal point F, and the angle $\alpha$2 of the extraction window 116 with respect to the X-ray focal point F are referred to as X-ray extraction angles, and these angles are 5° to 6°, for example. The X-ray extraction window 106 is the same as the X-ray extraction window 106 shown in FIG. 8. The X-ray extraction window 116 is not provided in the present embodiment shown in FIG. 8.

The X-ray focal point for the X-rays extracted from the window 106 on the short side of the real focus, and the X-ray focal point for the X-rays extracted from the window 116 on the long side of the real focus are referred to as effective foci. The effective focus of the X-rays extracted from the window 106 on the short side of the real focus is a 40×40 μm rectangle or a circle with a diameter $\phi$ of 40 μm when the real focus is 40×400 μm. On the other hand, when the real focus is 70×700 μm, the effective focus is 70 by 70 μm or $\phi$70 μm. The X-rays thus extracted are referred to as point focus X-rays.

The effective focus of the X-rays extracted from the window 116 on the long side of the real focus is a 4×400 μm rectangle when the real focus is 40×400 μm. On the other hand, when the real focus is 70×700 μm, the effective focus is a 7 by 700 μm rectangle. The X-rays thus extracted are referred to as line focus X-rays.

Point focus or line focus is selected for use as appropriate according to the type of measurement performed by an X-ray analysis device such as an X-ray diffractometer or an X-ray scattering apparatus. In the present embodiment, point focus X-rays are extracted from one X-ray extraction window 106 on a short side of the real focus F.

In FIGS. 7 and 8, the casing 102 has the function of maintaining a vacuum state on the inside thereof. The casing 102 is therefore equipped with an exhaust system provided with a turbo molecular pump and a rotary pump, or an exhaust system having any other configuration. However, the exhaust system is not shown in FIGS. 7 and 8. The shape of the casing 102 may change in the case that a different type of exhaust system is employed, but in any case, a hermetic seal is maintained inside the casing 102.

In FIG. 7, a support device 118 for the electron gun 103 is provided at an end part of the casing 102. The support device 118 has an insulator 119 formed of a ceramic, and a pedestal 120 which is fixed on the insulator 119. The attachment part 113 of the electron gun 103 is fixed on the pedestal 120 by a screw or other fixture. This fixing may also be accomplished by a fixing means other than a screw. The insulator 119 is supported on the casing 102 by a bearing 121 so as to be able to rotate about a center line X2 of the insulator 119. The rotational center line X2 of the insulator 119, and thus of the pedestal 120, intersects with the center line X3 of the width direction of the rotating anode 104 orthogonal to the rotational center line X0 of the rotating anode 104. Specifically, the rotational center line X2 intersects with the center line X3 of the rotating anode 104 that extends in the direction parallel to the plane of the disc of the rotating anode 104.

The insulator 119 and the pedestal 120 fixed thereto can rotate about the center line X2, but are usually fixed in the position shown in FIG. 8, i.e., the position where the Wehnelt electrode 112 of the electron gun 103 is in a straight line with the rotating anode 104. The position in which the Wehnelt electrode 112 is in a straight line with the rotating anode 104 is the position in which the Wehnelt electrode 112 is mounted on the center line (i.e., center line of the width direction of the rotating anode 104) X3 extending in the plane-parallel direction of the rotating anode 104.

Removing the Wehnelt electrode 112 from the fixed state described above enables the pedestal 120 and the electron gun 103 attached thereto to be rotatably driven, i.e., tipped, at a small angle about the line X2. The pedestal 120 can then be fixed at the position reached after the tipping movement. The purpose of such tipping movement of the electron gun 103 is to vary the impingement region of electrons on the outer circumferential surface of the rotating anode 104, i.e., the formation region of the X-ray focal point F, on the outer circumferential surface of the rotating anode 104. For example, since the left-side portion and right-side portion from the center of the outer circumferential surface of the rotating anode 104 are formed of different materials, the wavelength of X-rays generated from the outer circumferential surface of the rotating anode 104 can be varied by tipping the electron gun 103 in the left-right direction.

Figures 10, 10A:
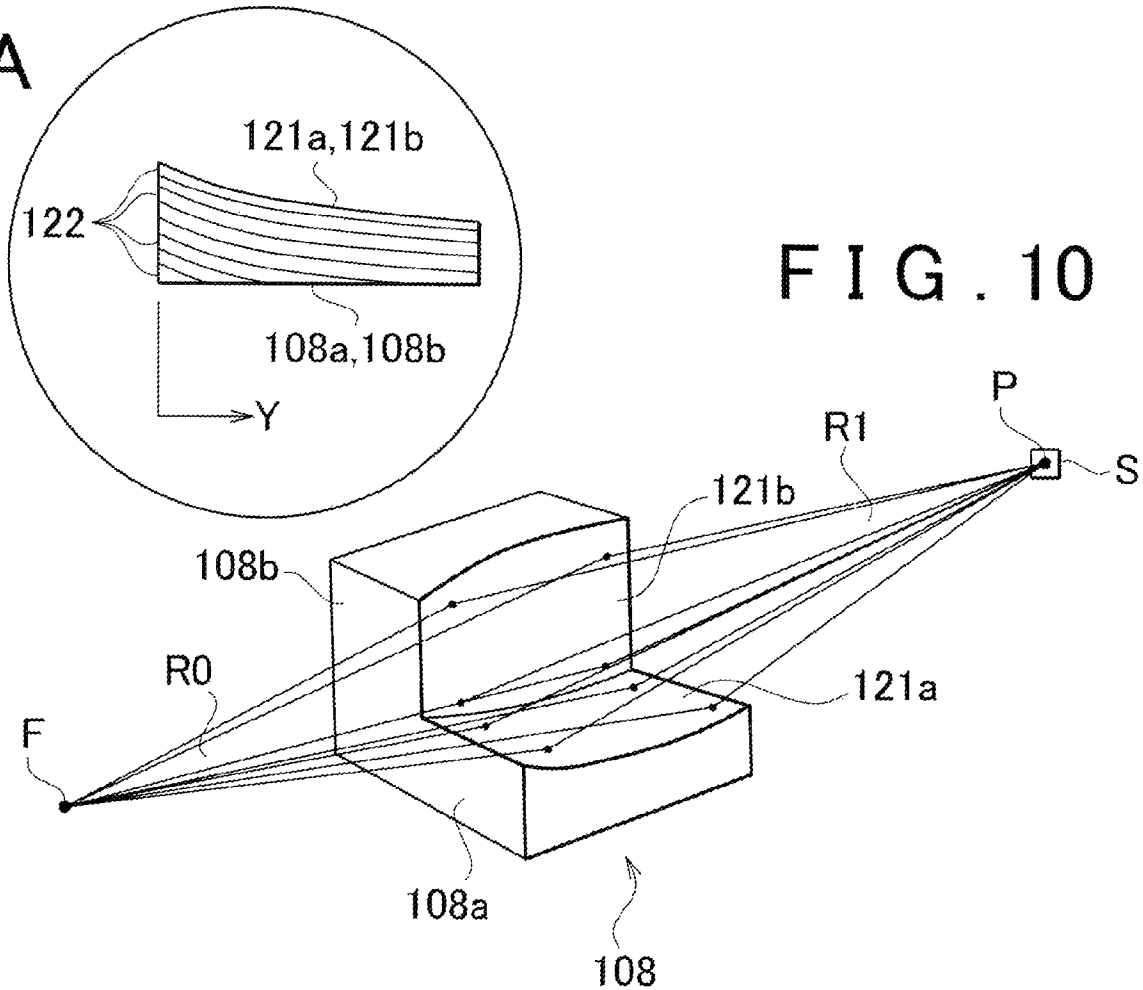
FIGS. 10 and 10A are perspective views showing the monochromator as a main part of FIG. 9.

The monochromator 108 of FIG. 8 monochromatizes X-rays which include X-rays of a plurality wavelength types that are emitted from the X-ray focal point F. Specifically, the monochromator 108 selectively extracts X-rays of a specific wavelength from X-rays of a plurality of wavelength types. In the present embodiment, the monochromator 108 is composed of a multilayer mirror having a so-called side-by-side structure. A Max-Flux (registered trademark) manufactured by Rigaku Corporation, for example, can be used as the multilayer mirror. As shown in FIG. 10, the side-by-side multilayer mirror is configured such that two multilayer mirrors 108*a*, 108*b* having curved X-ray reflection surfaces 121*a*, 121*b*, respectively, are disposed at right angles to each other, for example.

As shown schematically in the partial enlarged view FIG. 10A, the multilayer mirrors 108*a*, 108*b* are formed by laminating thin films 122 composed of a plurality of different materials in alternating fashion. Various combinations of materials, such as Ni (nickel) and C (carbon), Mo (molybdenum) and Si (silicon), W (tungsten) and $B_4C$, for example, can be laminated. In the partial enlarged view FIG. 10A, the thin films 122 are shown extremely thick for the sake of convenience, but the actual thin films 122 are extremely thin. The X-rays R0 emitted from the X-ray focal point F are reflected (i.e., diffracted) by the X-ray reflection surfaces 121*a*, 121*b*. The reflected X-rays R1 follow a progression path corresponding to the curved shape of the X-ray reflection surfaces 121*a*, 121*b*.

For example, when the X-ray reflection surfaces 121*a*, 121*b* are elliptical and the X-ray focal point F is placed at one elliptical focus, the reflected X-rays R1 are convergent X-rays that converge at the other elliptical focus. When the X-ray reflection surfaces 121*a*, 121*b* are parabolic, the reflected X-rays R1 are parallel X-rays. In the present embodiment, the X-ray reflection surfaces 121*a*, 121*b* are elliptical and set so that the reflected X-rays R1 converge at a position P at which a sample S is placed.

X-rays generally are diffracted when the Bragg diffraction condition $2d \sin \theta = n\lambda$ is satisfied. In the equation, "d" is the distance between lattice planes, "θ" is the Bragg angle (i.e., the incidence angle and reflection angle of X-rays), "n" is the order of reflection, and "λ" is the wavelength of X-rays used. The multilayer mirrors 108*a*, 108*b* are designed so that when the distance from the side of X-ray incidence is designated as Y, the value of d varies each time the value of Y varies, and X-rays are reflected (i.e., diffracted) in each position at the distance Y. High-intensity X-rays are thereby obtained as the reflected X-rays R1.

In FIG. 8, the X-ray shutter 107 provided between the X-ray extraction window 106 of the casing 102 and the monochromator 108 as the X-ray conditioning element is formed in a cylindrical shape extending in the direction perpendicular to the paper surface of FIG. 8, and is further provided with a through hole for passing X-rays in a direction that crosses the center line of the cylindrical shape. X-rays can be passed or the progress thereof blocked by aligning or not aligning the through hole with the X-ray progression path by rotating the X-ray shutter 107 about the center line thereof as indicated by the arrow C.

Since the X-ray generator 101 of the present embodiment is configured as described above, a vacuum state is set inside the casing 102 by the action of an exhaust system not shown in the drawings. The filament 111 then generates heat when power is applied thereto, and releases thermo electrons. The released electrons impinge upon the outer circumferential surface of the rotating anode 104 to form an X-ray focal point F while the progression direction of the electrons is controlled by the Wehnelt electrode 112. X-rays radiate in all directions in space from this X-ray focal point F.

When the X-ray shutter 107 is set so as to allow the passage of X-rays, the X-rays R0 that pass through the X-ray shutter 107 are incident on the X-ray reflection surface of the monochromator 108. The monochromator 108 monochromatizes the incident X-rays, and the monochromatized X-rays R1 converge on a region within the sample S. The slit 109 prevents unwanted X-rays from reaching the sample S. The X-rays incident on the sample S are diffracted according to the crystal structure of the sample S, and the diffracted X-rays are detected by an X-ray detector not shown in the drawings. The crystal structure of the sample S can be analyzed by analyzing the detection result.

The characteristics of the electron gun 103 gradually degrade over the course of X-ray generation. The electron gun 103 is replaced when the characteristics thereof degrade beyond an allowable limit. The need may also arise to replace the electron gun 103 with a different type of electron gun 103 according to the type of measurement. During such replacement of the electron gun 103, the cover 105 at the lateral end of the casing 102 is removed from the casing 102, a worker inserts a finger into the space K1 (referred to hereinafter as the pedestal housing space K1) in which the pedestal 120 is housed by the casing 102 and removes the attachment part 113 of the electron gun 103 from the pedestal 120, and takes the entire electron gun 103 out of the casing 102. The worker then inserts a different electron gun 103 into the pedestal housing space K1 and installs the electron gun 103 in a predetermined position with respect to the rotating anode 104 by fixing the attachment part 113 of the electron gun 103 to the pedestal 120.

In the present embodiment, the shape and dimensions relating to the casing 102 and other components are set in the following manner in FIG. 9. Each dimension shown is a rough value that includes an allowable error.

Width W10 of electron gun 103 (Wehnelt electrode 112): 10 mm

Width W11 of rotating anode 104: 10 mm

Distance W12 between the electron gun 103 (Wehnelt electrode 112) and the inside surface of the wall of the casing 102: 9.5 mm Distance W22 between the attachment part 113 of the electron gun 103 and the inside surface of the wall of the casing 102: 15 mm Distance W14 between the center line X3 extending in the plane-parallel direction of the rotating anode 104 and a distal end of the monochromator 108 X-ray conditioning element: 30 mm As described above, the distance W22 between the attachment part 113 of the electron gun 103 and the inside surface of the wall of the casing 102 is set to approximately 15 mm. These dimensions allow a worker to take the electron gun 103 in and out of the pedestal housing space K1 of the casing 102 without impediment.

In the present embodiment, the width W11 of the rotating anode 104 and the width W10 of the Wehnelt electrode 112 of the electron gun 103 are set smaller than the conventional technique. Accordingly, the width W32 of the space K2 (hereinafter referred to as the anticathode housing space K2) in which the rotating anode 104 is housed by the casing 102 is set smaller than the width W31 of the pedestal housing space K1 of the casing 102. With regard to the electron gun 103, the width W30 of the attachment part 113 is set so as to be substantially equal to the width of the conventional electron gun, and the width W10 of the Wehnelt electrode 112 (i.e., the main portion of the electron gun 103) that extends from the attachment part 113 is smaller than the width W30 of the attachment part 113. In the state in which the attachment part 113 of the electron gun 103 is attached to the pedestal 120, the Wehnelt electrode 112 formed with a narrow width as described above extends into the anticathode housing space K2 of the casing 102.

The aperture of the pedestal housing space K1 blocked by the cover 105 is provided in a plane of the pedestal housing space K1 on the opposite side from the anticathode housing space K2. The electron gun 103 can thereby be easily attached and detached via the aperture.

Due to the narrow width W32 of the anticathode housing space K2 of the casing 102 as described above, the distance W40 from the center line X3 of the plane-parallel direction (direction orthogonal to the width direction) of the rotating anode 104 to the X-ray extraction window 106 is less than the distance W41 from the center line X3 to the inside surface of the casing 102 in which the pedestal housing space K1 is formed. As a result, the distance W14 from the center line X3 extending in the plane-parallel direction of the rotating anode 104 to the distal end of the monochromator 108 is significantly reduced. For example, the distance W14 at which the monochromator 108 is disposed in the present embodiment is approximately 30 mm.

Having a small distance W14 from the center line X3 extending in the plane-parallel direction of the rotating anode 104 to the distal end of the monochromator 108 means that a large capture angle δ can be obtained for the X-rays R0 emitted from the X-ray focal point F that are captured by the monochromator 108, and that a large amount of X-rays can be captured by the monochromator 108. As a result, the X-ray focusing efficiency can be enhanced.

The X-ray shutter 107 in the present embodiment is provided in a position upstream from the monochromator 108 in the X-ray progression direction, but the X-ray shutter 107 may also be provided in a position downstream from the monochromator 108. The distance from the X-ray focal point F to the monochromator 108 can thereby be further reduced.

In the present embodiment as well, in FIG. 7, the field formation surface 112*a* of the Wehnelt electrode 112 forms the boundary of an aperture 114 for passing electrons that are generated from the filament 111. The Wehnelt plane S1 that includes the field formation surface 112*a* of the Wehnelt electrode 112 is inclined at an angle β with respect to the tangent plane S2 that includes a line tangent to the outer circumferential surface of the rotating anode 104 at the center of the X-ray focal point F on the outer circumferential surface of the rotating anode 104. The center line X1 of the coil ring of the filament 111 is aligned with the center of the aperture 114 for electron release and is in the plane S3 orthogonal to the field formation surface 112*a*, and thus to the Wehnelt plane S1.

Since the center line X1 of the filament 111 is provided in the center plane S3 of the Wehnelt aperture 114, the energy received from the electric field E (refer to FIG. 2) by the electrons emitted from the filament 111 is always uniform, and the electrons therefore progress linearly without curving, and form the X-ray focal point F on the outer circumferential surface of the rotating anode 104.

Since the Wehnelt plane S1 that includes the aperture 114, and the tangent plane S2 through the X-ray focal point F are inclined at the angle β, the center line X1 of the filament 111 is in a position that is offset a distance D with respect to the plane S4 through the rotational center line X0 of the rotating anode 104 and the center line of the X-ray focal point F. Therefore, in the case that positive ions are released from the rotating anode 104, the positive ions do not collide with the filament 111. A reduction in service life of the filament 111 due to impingement of positive ions can thereby be prevented, and the characteristics of the filament 111 can be maintained for a long time.

Since the filament 111 need only be disposed in the center position of the Wehnelt electrode 112, design is extremely simple, and the filament is also extremely simple to install.

Other Embodiments

The present invention is described above using preferred embodiments, but the present invention is not limited by these embodiments and can be modified in various ways within the scope of the invention as recited in the claims.

For example, the cathode 2 or filament 111 of FIG. 3 is not limited to a coiled or helical filament, and may be formed by a solid material formed of a boride such as $LaB_6$ (lanthanum hexaboride) or the like. The cathode 2 or the like may also be a predetermined length of an electron-generating material having a rectangular cross-sectional shape.

In the embodiment shown in FIG. 9, a configuration is adopted in which the electron gun 103 can be rotated, i.e., tilted, about the center line X2 thereof as shown in FIG. 9, but the present invention also encompasses a configuration in which the electron gun 103 is fixed in a state of always extending parallel to the center line X3 that extends in the plane-parallel direction of the rotating anode 104, rather than being tilted as described above.

The rotating anode 104 is also used as the anticathode in the embodiments described above, but a fixed-type anticathode may also be used.

What is claimed is:

1. An X-ray generator comprising:

a cathode for generating electrons;

a rotating anode having a cylindrical electron impingement surface, an X-ray focal point being formed by a region in which said electrons impinge upon the electron impingement surface; and a Wehnelt electrode for imparting an electric field to the electrons emitted from said cathode; wherein said Wehnelt electrode has a field formation surface for forming said electric field, and an electron passage aperture formed by the field formation surface;

the field formation surface of said Wehnelt electrode is inclined with respect to a plane tangent to an outer circumferential surface of said rotating anode at the center of said X-ray focal point, said Wehnelt electrode has a first space provided in a position near said electron passage aperture, and a second space in a position distant from said electron passage aperture, the second space being connected to said first space and having a volume smaller than that of the first space;

a portion of said cathode is in said first space, and the remainder of said cathode is in said second space;

a first X-ray blocking member is removably attached to a wall at a boundary portion between said first space and said second space; and a line normal to the outer circumferential surface of said rotating anode at the center of said X-ray focal point passes through said first space and intersects with said first X-ray blocking member.

2. The X-ray generator according to claim 1, wherein the center of said cathode is in a plane orthogonal to said field formation surface and aligned with the center of said electron passage aperture.

3. The X-ray generator according to claim 2, wherein the electrons emitted from said cathode progress linearly in the direction orthogonal to the field formation surface of said Wehnelt electrode.

4. The X-ray generator according to claim 1, wherein said first X-ray blocking member comprises a metal having molybdenum as a primary component thereof.

5. An X-ray generator comprising:

a cathode for generating electrons;

a rotating anode having a cylindrical electron impingement surface, an X-ray focal point being formed by a region in which said electrons impinge upon the electron impingement surface; and a Wehnelt electrode for imparting an electric field to the electrons emitted from said cathode; wherein said Wehnelt electrode has a field formation surface for forming said electric field, and an electron passage aperture formed by the field formation surface;

the field formation surface of said Wehnelt electrode is inclined with respect to a plane tangent to an outer circumferential surface of said rotating anode at the center of said X-ray focal point;

said Wehnelt electrode has a first space provided in a position near said electron passage aperture, and a second space in a position distant from said electron passage aperture, the second space being connected to said first space and having a volume smaller than that of the first space;

a portion of said cathode is in said first space, and the remainder of said cathode is in said second space;

said second space is covered by a second X-ray blocking member; and a line normal to the outer circumferential surface of said rotating anode at the center of said X-ray focal point passes through said second space surrounding said cathode and intersects with said second X-ray blocking member.

6. The X-ray generator according to claim 5, wherein the center of said cathode is in a plane orthogonal to said field formation surface and aligned with the center of said electron passage aperture.

7. The X-ray generator according to claim 5, wherein said second X-ray blocking member comprises a metal having tungsten as a primary component thereof.

8. The X-ray generator according to claim 7, wherein the electrons emitted from said cathode progress linearly in the direction orthogonal to the field formation surface of said Wehnelt electrode.

* * * * *